US009328534B2

(12) United States Patent
Blankenship

(10) Patent No.: US 9,328,534 B2
(45) Date of Patent: May 3, 2016

(54) SAFE AND LOCK MECHANISM

(71) Applicant: Michael Blankenship, Santa Fe, TX (US)

(72) Inventor: Michael Blankenship, Santa Fe, TX (US)

( * ) Notice: Subject to any disclaimer, the term of this patent is extended or adjusted under 35 U.S.C. 154(b) by 0 days.

(21) Appl. No.: 14/253,001

(22) Filed: Apr. 15, 2014

(65) Prior Publication Data

US 2014/0311390 A1 Oct. 23, 2014

Related U.S. Application Data

(60) Provisional application No. 61/813,365, filed on Apr. 18, 2013.

(51) Int. Cl.

| | |
|---|---|
| ***E05B 65/52*** | (2006.01) |
| ***E05B 37/00*** | (2006.01) |
| ***E05B 37/16*** | (2006.01) |
| ***E05B 65/00*** | (2006.01) |
| ***E05G 1/04*** | (2006.01) |
| *E05G 1/00* | (2006.01) |

(52) U.S. Cl.

CPC ..... *E05B 65/52* (2013.01); *E05B 37/0034* (2013.01); *E05B 37/16* (2013.01); *E05B 65/0075* (2013.01); *E05G 1/04* (2013.01); *E05G 1/005* (2013.01); *Y10T 70/5031* (2015.04)

(58) Field of Classification Search

CPC ..... E05B 65/52; E05B 37/0034; E05B 37/16; E05B 65/0075; E05G 1/04; E05G 1/005; Y10T 70/5031

USPC ..... 70/298, 294, 284, 285, 287, 289, 291, 70/300, 8, 63, 69; 109/64

See application file for complete search history.

(56) References Cited

U.S. PATENT DOCUMENTS

| | | | | | |
|---|---|---|---|---|---|
| 338,205 | A | * | 3/1886 | Sturgis | 70/88 |
| 473,401 | A | * | 4/1892 | Lighton | 70/88 |
| 479,374 | A | * | 7/1892 | Mahannah | 70/88 |
| 494,154 | A | * | 3/1893 | Morford | 70/88 |
| 495,911 | A | * | 4/1893 | Ringen | 70/298 |
| 507,957 | A | * | 10/1893 | Wood | 70/88 |
| 551,955 | A | * | 12/1895 | Gledhill | 70/88 |
| 612,335 | A | * | 10/1898 | Haggstrom | 70/287 |
| 690,191 | A | * | 12/1901 | Saxe | 70/352 |
| 1,236,402 | A | * | 8/1917 | Christie | 70/297 |
| 1,377,625 | A | * | 5/1921 | Peebles | 70/306 |
| 2,162,995 | A | * | 6/1939 | Bruington | 70/298 |
| 2,732,704 | A | * | 1/1956 | Murray | 70/313 |
| 2,967,419 | A | * | 1/1961 | Katona | 70/313 |
| 3,514,981 | A | * | 6/1970 | Esquibel et al. | 70/298 |
| 3,664,231 | A | * | 5/1972 | Hanson | 70/292 |

(Continued)

*Primary Examiner* — Christopher Boswell
*Assistant Examiner* — Amanda Miller
(74) *Attorney, Agent, or Firm* — Daniel Boudwin; Global Intellectual Property Agency LLC

(57) ABSTRACT

Described is a locking mechanism for a lock box comprising a plurality of buttons connected to either a sliding dawg or a dummy dawg. The sliding and dummy dawgs are supported by a retaining bar in a first position and can slide into a second position when its corresponding button is pressed. Each dawg comprises a hook that is adapted to engage with a lock bar. The sliding dawgs have hooks that are engaged with the lock bar until the corresponding button is pressed, while the dummy dawgs have hooks that are not engaged with the lock bar unless the corresponding button is pressed. The locking mechanism locks if a button corresponding to a dummy dawg has been pressed, and the locking mechanism can then be opened only by use of a key. The locking mechanism opens if the correct buttons are pressed, regardless of the sequence.

8 Claims, 3 Drawing Sheets

(56) References Cited

U.S. PATENT DOCUMENTS

| | | | | | |
|---|---|---|---|---|---|
| 3,732,831 | A * | 5/1973 | Marciniak et al. | 109/83 |
| 3,779,715 | A * | 12/1973 | Wendler et al. | 428/568 |
| 4,569,214 | A * | 2/1986 | Yang | 70/298 |
| 4,696,240 | A * | 9/1987 | Maxeiner | 109/82 |
| 4,936,894 | A | 6/1990 | Larson et al. | |
| 4,966,020 | A | 10/1990 | Fotheringham et al. | |
| 5,189,894 | A * | 3/1993 | Buck | 70/63 |
| 5,870,910 | A | 2/1999 | Specht | |
| 6,341,513 | B1 | 1/2002 | Chen | |
| 6,523,971 | B1 | 2/2003 | Nikl | |
| 7,434,427 | B1 * | 10/2008 | Miresmaili | 70/63 |

* cited by examiner

SAFE AND LOCK MECHANISM

CROSS REFERENCE TO RELATED APPLICATION

This application claims the benefit of U.S. Provisional Application No. 61/813,365 filed on Apr. 18, 2013, entitled "Quick Safe." The above identified patent application is herein incorporated by reference in its entirety to provide continuity of disclosure.

BACKGROUND OF THE INVENTION

1. Field of the Invention

The present invention relates to locking mechanisms and a safe having a locking mechanism. More specifically, the present invention relates to a locking mechanism adapted for use with a safe comprising a plurality of buttons connected to sliding dawgs or dummy dawgs which are capable of engaging with a stationary locking bar. Sliding dawgs engage with the lock bar when the corresponding button is pressed, while dummy dawgs disengage with said lock bar when the button corresponding to the dummy dawg is pressed. The locking mechanism will only unlock when a user presses only the correct buttons, and the locking mechanism will lock when a user presses an incorrect button.

Safes are commonly used to store guns and valuables in order to prevent unauthorized access of these items. The safe may be used to store guns to prevent children from gaining access to the guns. Alternatively, the safe may be used to store valuables to prevent intruders from gaining access. However, during an emergency situation in which the safe owner wishes to withdraw valuables or a weapon from the safe, it can be difficult and time consuming to open traditional safes. During an emergency, particularly at night when it is dark, it may be difficult for the safe owner to find the key to the safe and unlock the safe in a timely manner. Similarly, it may be difficult for the owner of a safe having a combination lock to enter the correct combination in a dark room or during an emergency situation. If an intruder is in the home, the owner may wish to quickly withdraw a weapon from the safe, or if there is a fire, the owner may wish to quickly withdraw valuables from the safe.

The present invention discloses a locking mechanism adapted for use with a safe comprising a plurality of buttons that are connected to sliding dawgs. The sliding dawgs engage with a stationary locking bar, and disengage with said locking bar when the appropriate buttons are pressed. Once the sliding dawgs are disengaged, the safe can be opened. The locking mechanism of the present invention allows the safe owner to quickly gain access to the safe simply by pressing the proper buttons on the safe, regardless of the sequence. The buttons may further be illuminated in order to allow the safe owner to easily view the buttons in a dark room or during the night.

2. Description of the Prior Art

Devices have been disclosed in the prior art that relate to safes and locking mechanisms. These include devices that have been patented and published in patent application publications. These devices generally relate to safe locks. The following is a list of devices deemed most relevant to the present disclosure, which are herein described for the purposes of highlighting and differentiating the unique aspects of the present invention, and further highlighting the drawbacks existing in the prior art.

U.S. Pat. No. 6,341,513 to Chen entitled "Two-in-One Combination Safe Lock" discloses a combination safe lock that includes a mechanical lock device and an electronic lock device housed in a single box, so that the safe can be opened either mechanically or electronically. The mechanical lock device includes a shaft that is inserted through the box with a numeric dial set outside the safe door. The safe door can be opened by rotating the numeric dial. Alternatively, the safe door can be opened electronically by inputting the access code through the circular pushbutton plate. Chen discloses a locking device that can be unlocked by pressing a series of buttons, but Chen discloses a safe that can be opened by electronic means, and does not describe buttons connected to sliding dawgs.

U.S. Pat. No. 4,936,894 to Larson et al. entitled "Pushbutton Lock" discloses a lock having a plurality of buttons each having two slots or gates on opposite sides of the button at different positions along the button's length. The lock further includes a checker plate slidably mounted in a track and coupled to a locking bolt. For the locking bolt to be moved to an unlocked position, the checker plate must be slid through the gates on the plurality of buttons. Therefore, the buttons must all be positioned so that each presents a gate into which the advancing portion of the checker plate can be received. Larson et al. discloses a lock that can be opened by entering a series of buttons, but does not disclose buttons connected to sliding dawgs that engage a locking bar. Instead, Larson discloses buttons having slots or gates that must align to allow a checker plate to slide through said slots or gates so that the lock may be opened.

U.S. Pat. No. 4,966,020 to Fotheringham et al. entitled "Locking Mechanism" discloses a locking mechanism that prevents sliding movement between a container and a container locking structure. The device further includes a separate decoupling unit that can be used to disengage the container and locking structure. The locking mechanism has a magnetically attractable pin that is moveable between a position that prevents sliding and a second position that allows sliding such that the locking mechanism can be opened. Fotheringham discloses a locking mechanism that is opened using a separate decoupling unit, and does not disclose a locking mechanism comprising a plurality of buttons that must be pressed.

U.S. Pat. No. 5,870,910 to Specht entitled "Lock-Down Security Box" discloses a portable security box that can be anchored to a location to prevent unauthorized removal from that location. The security box can be secured to a lock-down plate that is fixed to a table, wall, or other mounting surface. The security box can be removed from the lock down plate by activation of a lock mechanism. The device includes a second lock set that is used to provide controlled access to the contents of the security box. Specht discloses a security box that can be locked to a lock-down plate, and that includes a second lock set for opening the security box. Specht does not disclose a locking mechanism wherein a user must press a series of buttons in order to disengage sliding dawgs from a locking bar.

U.S. Pat. No. 6,523,971 to Nikl entitled "Anti-Tamper Device" discloses an enclosure for securing a lock box and having a first and second obstructing panel that allows a user's hand to access the interior of the enclosure, but such that there is no visibility from the outside of the container. In this way, the enclosure having two obstructing panels eliminates the possibility of inserting a prying instrument capable of reaching and damaging locks. Thus, Nikl does not disclose a locking mechanism but an enclosure for housing a lock box that prevents said lock box from being tampered with by unauthorized users.

These prior art devices have several known drawbacks. The devices disclosed involve safes and locking mechanisms having various arrangements. The devices in the prior art do not disclose a locking mechanism that can quickly and easily be unlocked by a user. Prior art devices include safes having combination locks which may be difficult to open in the dark or in an emergency situation. Similarly, safes requiring keys or separate decoupling units may be inconvenient for a user in an emergency situation because the user is required to locate the key or decoupling unit in order to access the safe.

The present invention discloses a locking mechanism adapted for use with a safe comprising a plurality of buttons connected to sliding dawgs. The sliding dawgs engage with a stationary lock bar and can be disengaged when a user presses the appropriate buttons. In this way, the safe owner is provided with easy access to the safe simply by pressing a series of buttons. The locking mechanism includes one or more dummy dawgs that engage with the locking bar when the button corresponding to said dummy dawg has been pressed.

In light of the devices disclosed in the prior art it is submitted that the present invention substantially diverges in design elements from the prior art and consequently it is clear that there is a need in the art for an improvement to existing safe locking mechanisms. In this regard the instant invention substantially fulfills these needs.

SUMMARY OF THE INVENTION

In view of the foregoing disadvantages inherent in the known types of safe locking mechanisms now present in the prior art, the present invention provides a new safe locking mechanism wherein the same can be utilized for providing convenience for the user when storing valuables or guns in a safe.

It is therefore an object of the present invention to provide a new and improved safe locking device that has all of the advantages of the prior art and none of the disadvantages.

It is another object of the present invention to provide a locking mechanism that can be easily and quickly unlocked by the owner during an emergency situation.

Another object of the present invention is to provide a locking mechanism that prevents unauthorized users from gaining access to the contents of a safe on which the locking mechanism is installed.

Yet another object of the present invention is to provide a locking mechanism having a means for alerting or notifying the safe owner that the safe has been tampered with by an unauthorized user.

Another object of the present invention is to provide a locking mechanism that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
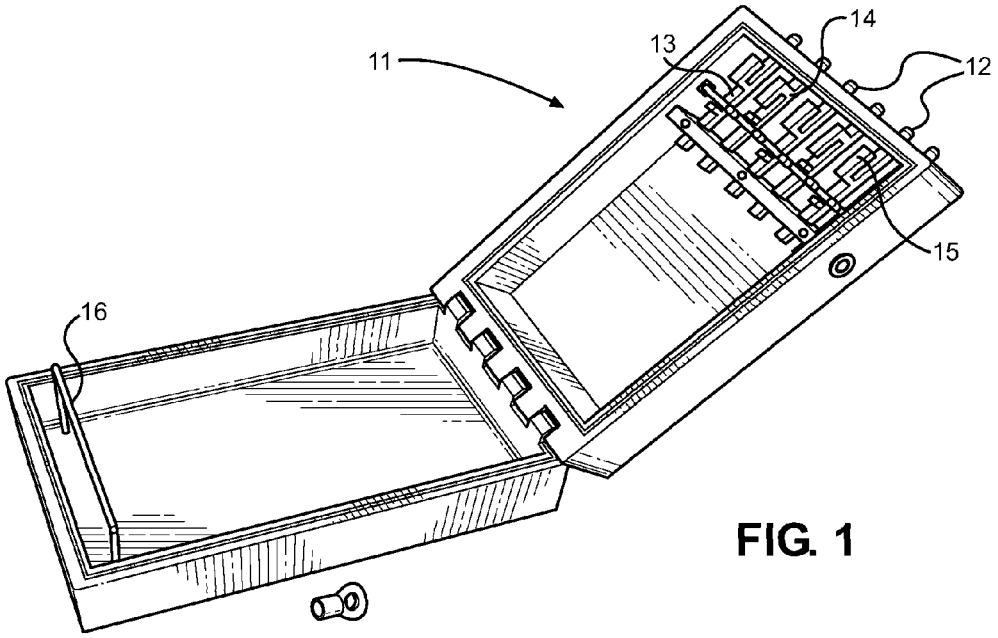
FIG. 1 shows a perspective view of the locking mechanism of the present invention as installed on a safe.

Reference is made herein to the attached drawings. Like reference numerals are used throughout the drawings to depict like or similar elements of the locking mechanism. For the purposes of presenting a brief and clear description of the present invention, the preferred embodiment will be discussed as used for providing a user with a secure locking mechanism that can be quickly unlocked. The figures are intended for representative purposes only and should not be considered to be limiting in any respect.

Referring now to FIG. 1, there is shown a perspective view of the locking mechanism of the present invention as installed on a safe. The locking mechanism 11 includes buttons 12 that are disposed on the external surface of a first side of a safe, and extend outward therefrom. When a user presses a button, the button withdraws into the wall of the safe such that the face of the button is flush with the external surface of the safe. In this way, a button that has been pressed cannot be pressed a second time. Each button is connected to either a sliding dawg 13 or a dummy dawg 14 such that when the button is pressed, the sliding or dummy dawg moves from a first to a second position. Both sliding dawgs and dummy dawgs have hooks 15. The sliding dawgs 13 have hooks 15 that face towards the button side of the safe, while dummy dawgs 14 have hooks 15 that face towards the hinge side of the safe. The locking mechanism further comprises a stationary lock bar 16 that is attached to a second side of a safe, and that is adapted to engage with the hooks on the sliding and dummy dawgs when the safe is closed. The lock bar extends above the plane of the safe housing so as to allow the lock bar to engage with the sliding and dummy dawgs when the safe is closed. The locking mechanism remains locked so long as at least one hook is engaged with the lock bar.

Figure 2:
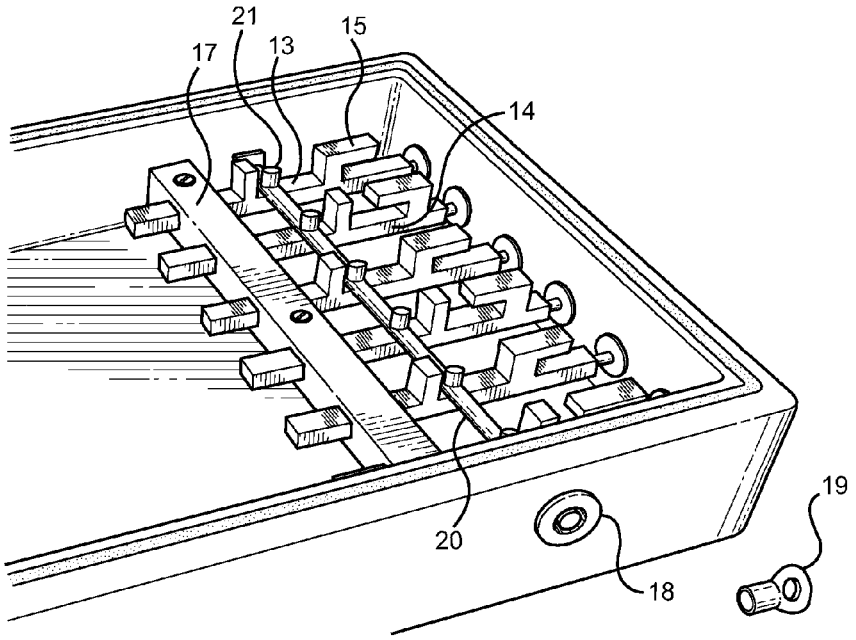
FIG. 2 shows a perspective view of the sliding dawgs of the locking mechanism.

Referring now to FIG. 2, there is shown a perspective view of the sliding and dummy dawgs of the present invention. When a user presses a button on the outside of the case, the corresponding dawg moves from a first position to a second position. The dawgs move from a first position to a second position by sliding within the retaining bar 17. The retaining bar comprises channels adapted to receive the dawgs and in which allow the dawgs to slide therein. Sliding dawgs 13 have hooks 15 that face the button side of the case, and the sliding dawgs are engaged with the lock bar when the safe is locked. Upon pressing a button corresponding to a sliding dawg, the sliding dawg moves to a second position wherein the hook is disengaged from the lock bar. Conversely, when the locking mechanism is locked, and no buttons have been pressed, the dummy dawgs 14 are not engaged with the lock bar. When a user presses a button corresponding to a dummy dawg, the dummy dawg moves to a second position in engagement with the lock bar. Thus, once a single button corresponding to a dummy dawg has been pressed, the locking mechanism is locked. Even if the user presses the correct buttons afterwards, the locking mechanism remains locked.

Given that all sliding dawgs must be disengaged from the lock bar before the locking mechanism can be opened, the buttons corresponding to sliding dawgs can be pressed in any order, or even simultaneously. In this way, a person privy to the series of buttons that cause the locking mechanism to unlock can quickly and easily unlock the locking mechanism. In some embodiments of the invention, the buttons are illuminated so as to allow a user to easily see the buttons in a dark room.

However, once a dummy dawg has engaged the lock bar, the safe cannot be opened by pressing the appropriate buttons. Thus, the locking mechanism is further provided with a keyhole 18 adapted to receive a key 19 capable of unlocking the locking mechanism. Turning the key within the key-hole turns a releasing bar 20 that is fitted with knobs 21 that are capable of causing the dawgs to release from the locking bar. Since the locking mechanism cannot be opened once a button corresponding to a dummy dawg has been pressed, the safe owner will be aware if someone has tried to unsuccessfully access the safe. In some embodiments of the present invention, the locking mechanism may further comprise an alarm that will create an audible sound when a button corresponding to a dummy dawg has been pressed.

Figure 3A:
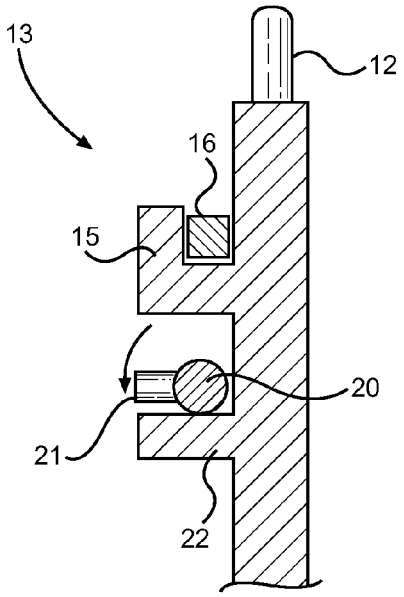
FIG. 3A shows a side view of an individual sliding dawg in a first position.
Figure 3B:
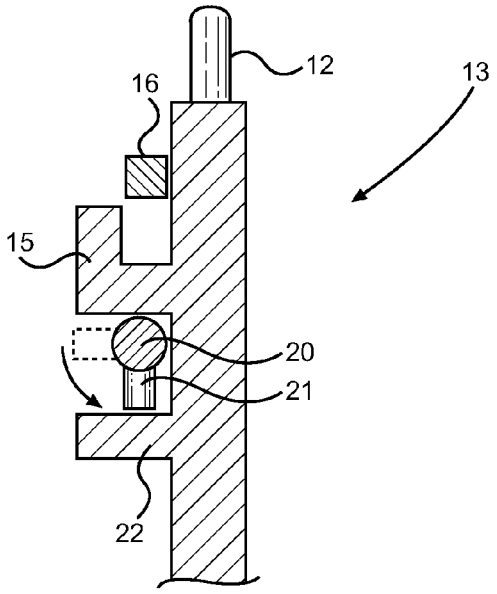
FIG. 3B shows a side view of an individual sliding dawg in a second position.

Referring now to FIGS. 3A and 3B, there is shown an individual sliding dawg in a first and second position, respectively. A sliding dawg 13 is connected to a single button 12, and comprises a hook 15 and a tab 22. In the first position shown in FIG. 3A, the hook 15 is engaged with the lock bar 16 such that the locking mechanism is locked. The releasing bar 20 has a knob 21 that is aligned with the tab 22 such that if the releasing bar 20 is rotated, knob 21 will engage tab 22, and cause the dawg 13 to move into a second position. The releasing bar can be rotated by turning the key within the keyhole. FIG. 3B shows a sliding dawg in a second position wherein the knob has engaged the tab on the dawg. By shifting the dawg into a second position, the lock bar 16 is disengaged with hook 15. In this way, the locking mechanism can be unlocked by use of a key. Once the dawg is in the second position as shown in FIG. 3B, the user could rotate the releasing bar in the opposite direction such that the knob on the releasing bar engages with the hook, causing the sliding dawg to return the first position wherein the locking mechanism is locked. Any dummy dawgs engaged with the lock bar can be disengaged from the lock bar in a similar fashion. The releasing bar can be rotated such that the knob on the releasing bar engages the tab on the dummy dawg, allowing the dummy dawg to move into a second position in which the hook of the dummy dawg is disengaged with the lock bar. Accordingly, the locking mechanism can be unlocked by rotating the releasing bar so as to disengage all of the sliding and dummy dawgs from the lock bar.

The user may choose which buttons correspond to dummy dawgs and which correspond to sliding dawgs. In this way, the user can personalize the combination, or alter the combination in the event that the series of numbers required to be entered has become known to a third party. The retaining bar and releasing bar may be removed, and the user can then rearrange the sliding dawgs and dummy dawgs in the desired fashion. Once the desired arrangement has been made by the user, the user would reposition the retaining bar and releasing bar.

The present invention also relates to a safe having the locking mechanism of the present invention. The safe comprises a first and a second portion. Both portions have side walls, a bottom, and an open end. The first and second portions are arranged such that the open end of the first portion faces the open end of the section portion. In this way, the first and second portions enclose an interior space. The first and second portion is further connected on a first side of the safe by a hinge. The first portion of the safe comprises the locking mechanism, which is positioned at a second end of the safe, opposite the end of the safe having a hinge. The buttons of the locking mechanism extend outward from the exterior surface of the safe. The second portion of the safe comprises a stationary lock bar on the end of the second portion opposite the hinge. When the safe is closed, the locking mechanism of the first portion of the safe is capable of engaging with the lock bar of the second portion of the safe.

Figure 4:
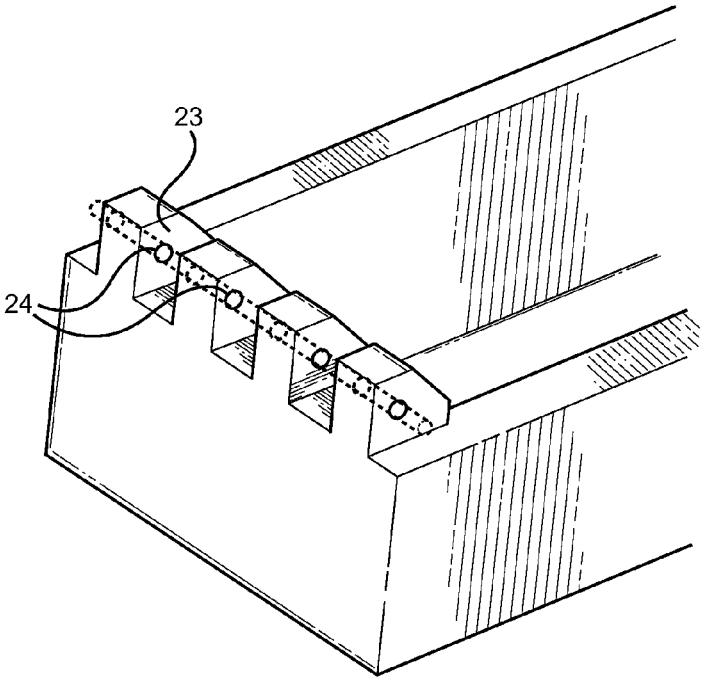
FIG. 4 shows a perspective view of the knuckle-hinged lid having an overhanging lip.

Referring now to FIG. 4, there is shown a perspective view of the knuckle-hinged lid having an overhanging lip. The first portion of the safe is attached to the second portion of the safe by means of a hinge. The lid can rotate about the hinge such that the safe may be opened or closed. In the embodiment shown in FIG. 4, the hinge on the first portion of the safe comprises a plurality of knuckles 23 each having an aperture 24 adapted to receive a hinge-pin. The apertures in each knuckle are aligned so that a hinge-pin can extend through all of the knuckles. The second portion of the safe has a hinge component that is capable of mating with the hinge shown in FIG. 4. By positioning the hinge-pin on the interior of the knuckles, the hinge-pin will be entirely obscured when the safe is assembled. This helps to protect against any attempts to pry open the hinge of the safe or to damage the hinge-pin so as to cause the safe to open by use of force.

Figure 5:
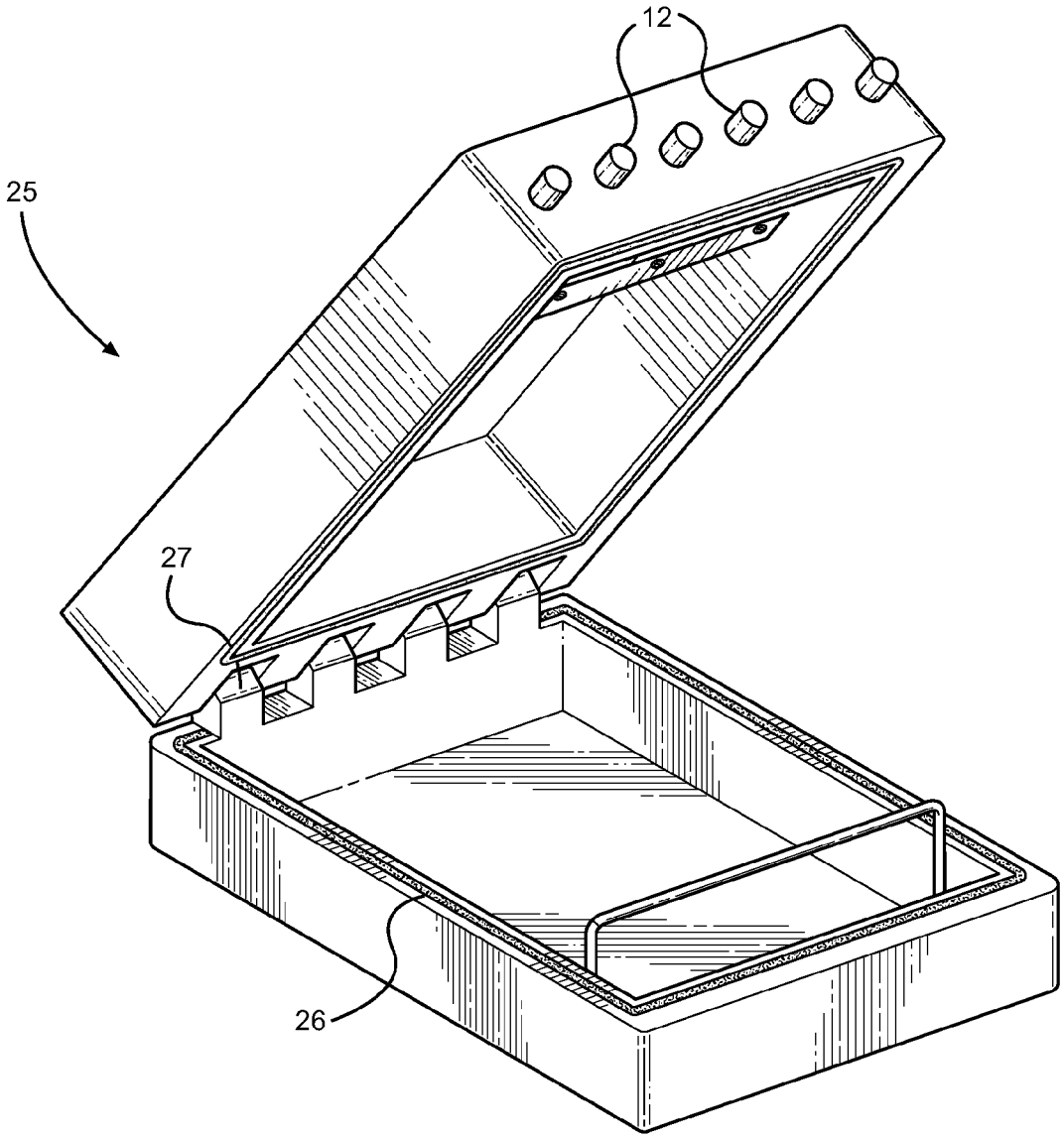
FIG. 5 shows a perspective view of the safe of the present invention in a partially closed configuration.

Referring now to FIG. 5, there is shown a perspective view of the safe of the present invention in a partially closed configuration. The safe 25 is show as having a first portion and a second portion. The buttons 12 are arranged linearly on the front of the safe. In some embodiments of the present invention, the buttons can be numbered in increasing order from left to right. The first portion of the safe rotates about a hinge 27 such that the safe can be opened or closed. In the embodiment of the safe shown, a rubber gasket 26 extends around the perimeter of upper surface of the sidewalls of the safe. When the safe is closed, the rubber gasket serves as a water proof seal. A rubber gasket may be disposed on one or both portions of the safe.

In some embodiments of the safe of the invention, the side walls, bottom, and lid of the safe comprise tungsten bars. Tungsten bars could be built-into the sidewalls, bottom, and lid of the safe so as to prevent unauthorized persons from sawing through the safe. The tungsten bars are adapted to roll such that when a saw contacts a tungsten bar, the sawing motion would cause the tungsten bar to roll or spin in place. In this way, the saw would not be able to break through the tungsten bars.

Locking mechanisms having combination locks require a user to slowly and precisely enter the combination in order to unlock the device. In an emergency situation in which the user wishes to quickly access the contents of a safe, a user may not have sufficient time to enter the combination. Further, the combination lock may be difficult to open in a dark room or at night. Similarly, locking mechanisms that can only be opened using a key are also inconvenient for the user. The user must first locate the key before using it to open the safe. In an emergency, the user may be unable to find the key, preventing the user from gaining access to the safe. Moreover, the user may find it difficult to use the key to open the safe in a dark room.

The present invention provides a locking device comprising a plurality of buttons each connected to either a sliding dawg or a dummy dawg. The sliding dawgs and dummy dawgs each have hooks adapted to engage a lock bar. The locking mechanism remains locked as long as one hook is engaged with the lock bar. The sliding dawgs and dummy dawgs are capable of sliding from a first position into a second position when the corresponding button has been pressed. Sliding dawgs are engaged in a first position, and are disengaged when the corresponding button is pressed. Dummy dawgs are disengaged in a first position, and engage when the corresponding button has been pressed. Once a dummy dawg is engaged, the locking mechanism can only be unlocked using a key. The user may unlock the locking mechanism by pressing all of the correct buttons individually, or simultaneously. In this way, the present invention provides users with a locking mechanism that can quickly and easily be unlocked by the owner.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A locking mechanism, comprising:

a sliding dawg comprising a tab;

a dummy dawg comprising a tab;

a sliding dawg button operably connected to the sliding dawg;

a dummy dawg button operably connected to the dummy dawg;

a stationary lock bar that is configured to engage with the sliding dawg and the dummy dawg;

wherein the sliding dawg is adapted to disengage with the lock bar when the sliding dawg button is pressed;

wherein the dummy dawg is adapted to engage with the lock bar when the dummy dawg button is pressed;

a releasing bar having a knob adapted to engage with at least one of the tab of the sliding dawg or the tab of the dummy dawg;

wherein actuation of the knob causes the sliding dawg or the tab of the dummy dawg to disengage with the lock bar;

wherein the releasing bar is configured to rotate via engagement of a key with a keyhole.

2. The locking mechanism of claim 1, further comprising a retaining bar perpendicular to the sliding dawg and the dummy dawg, wherein said retaining bar comprises a plurality of channels adapted to receive the sliding dawg and the dummy dawg, and wherein said retaining bar is adapted to allow the sliding dawg and the dummy dawg to slide therein.

3. The locking mechanism of claim 1, wherein the sliding dawg and the dummy dawg each comprise a hook, and wherein the sliding dawg and the dummy dawg engage with said lock bar by means of said hooks.

4. The locking mechanism of claim 1, wherein the sliding dawg and the dummy dawg are removable and interchangeable.

5. The locking mechanism of claim 1, wherein the sliding dawg button and the dummy dawg button are each adapted to lock into a depressed position once pressed.

6. A safe having the locking mechanism of claim 1, comprising:

a first portion and a second portion;

wherein said first and second portion each comprise sidewalls, a bottom, and an open upper end;

wherein said first and second portion are connected by a hinge such that said open upper end of said first portion faces said open upper end of said second portion;

wherein the sliding dawg and the sliding dawg button are positioned on said first portion; and wherein said lock bar is positioned on said second portion.

7. The safe of claim 6, wherein the safe further comprises a gasket disposed about an upper surface of said sidewalls of said first portion, and adapted to provide a water proof seal when said safe is closed.

8. The safe of claim 6, wherein said hinge comprises a plurality of knuckles each having an aperture adapted to receive a hinge-pin.

* * * * *